United States Patent [19]

Hausen

[11] Patent Number: 4,587,819

[45] Date of Patent: May 13, 1986

[54] METHOD AND CIRCUIT FOR FLATNESS CONTROL IN ROLLING MILLS

[75] Inventor: Marek Hausen, Mannheim, Fed. Rep. of Germany

[73] Assignee: Brown, Boveri & Cie Aktiengesellschaft, Mannheim, Fed. Rep. of Germany

[21] Appl. No.: 646,906

[22] Filed: Aug. 31, 1984

[51] Int. Cl.[4] ..... B21B 37/06; B21B 37/08

[52] U.S. Cl. ..... 72/9; 72/17; 72/243; 72/247; 73/862.07

[58] Field of Search ..... 72/17, 247, 8, 9, 10, 72/11, 12, 20, 243, 245; 73/862.07, 159

[56] References Cited

U.S. PATENT DOCUMENTS

| | | | |
|---|---|---|---|
| 4,262,511 | 4/1981 | Boisvert et al. | 72/17 |
| 4,269,051 | 5/1981 | Clarke et al. | 72/17 X |
| 4,400,957 | 8/1983 | Carlstedt et al. | 72/247 |

*Primary Examiner*—Francis S. Husar
*Assistant Examiner*—Steve Katz
*Attorney, Agent, or Firm*—Herbert L. Lerner; Laurence A. Greenberg

[57] ABSTRACT

A method for controlling flatness in cold-rolling mills having a roll stand with at least six rolls including intermediate and working rolls capable of being deflected, includes measuring tensile stress distribution over the width of a strip to be rolled having central and edge regions, comparing the measured tensile stress distribution with a desired predeterminable tensile stress distribution, determining a deviation at the central region of the strip between the measured and desired tensile stress distribution, determining a deviation at the edge region of the strip between the measured and desired tensile stress distribution, forming a strip center coefficient from the central region deviation in the form of a deviation control for influencing deflection of the intermediate roll, and forming a strip edge coefficient from the edge region deviation in the form of a deviation control for influencing deflection of the working roll, and a circuit for carrying out the method.

19 Claims, 6 Drawing Figures

METHOD AND CIRCUIT FOR FLATNESS CONTROL IN ROLLING MILLS

The invention relates to a method for flatness control in cold-rolling mills having a roll stand with six or more rolls, which includes measuring the tensile stress distribution over the width of the strip to be rolled, comparing the tensile stress distribution with a predeterminable specified or desired distribution, and forming a coefficient which serves for the adjustment of the roll deflection from the deviation between the actual distribution and the specified distribution. The invention further relates to a circuit for carrying out the method.

Flatness defects occur in cold-rolled strips of steel, aluminum or other non-ferrous metals if the strips in the rolling gap are non-uniformly deformed over the width of the strip. The differently deformed locations of the strip then lead to length differences of the individual strip fibers, i.e., lack of flatness. The quality characteristics of cold-rolled strips referred to as "flatness" is accordingly defined as follows:

All fibers have the same length in the longitudinal direction.

Methods for determining flatness defects have been described in the publication "Methoden der Qualitätssicherung bei NE-Metallen" (Methods for Quality Assurance in Non-Ferrous Metals) Deutsche Gesellschaft für Metallkunde e.V., Bad Nauheim, 1978. In order to judge the flatness defects, the tensile stress distribution is measured over the width of the strip to be rolled or already rolled.

Through the article entitled "Regelung der Bandplanheit in Kaltwalzwerken" (Control of Flatness Defects in Cold-Rolling Mills), BBC Nachrichten, 1980, page 451 to 456, control systems have become known for keeping flatness defects small by influencing regulating units for measuring tensile stress distribution. Swinging the rolls counteracts wedge-shaped defects; deflection of the rolls counteracts parabolic defects; and influencing the amount and distribution of the emulsion counteracts parabolic and irregular defects.

The present invention therefore more specifically relates to methods and circuits for adjusting the roll deflection due to measurement results of the tensile stress distribution. The invention relates to cold-rolling mills with roll stands which have at least six rolls, i.e., which contain a pair of working rolls, one or more pairs of intermediate rolls, and a pair of support rolls.

The use of intermediate rolls permits an increased range of adjustment for the deflection of the working rolls. As a rule, only the deflection of the the working rolls is controlled in roll stands with intermediate rolls. However, roll stands are also known, in which the deflection of a pair of working rolls as well as that of a pair of intermediate rolls is controlled. A common control parameter is used in this case for both controls.

However, it is a disadvantage of such a control that the control possibilities cannot be utilized optimally due to the common control parameter. This is due to the fact that a deflection of the thin working rolls primarily influences the tensile stress distribtion in vicinity of the strip edge, while a deflection of the intermediate rolls reflects the tensile stress distribution over the entire width of the strip. For this reason, a compromise between the different effects of the roll deflection must be found if a common control parameter is to be used.

It is accordingly an object of the invention to provide a method and apparatus for flatness control in rolling mills, which overcomes the hereinafore-mentioned disadvantages of the heretofore-known devices of this general type, through which decoupling of the deflection control of the working rolls and the deflection control of the intermediate rolls takes place, and optimum flatness control can be carried out.

With the foregoing and other objects in view there is provided, in accordance with the invention, a method for controlling flatness in cold-rolling mills having a roll stand with at least six rolls including intermediate and working rolls capable of being deflected, which comprises measuring tensile stress distribution over the width of a strip to be rolled having central and edge regions, comparing the measured tensile stress distribution with a desired predeterminable tensile stress distribution, determining a deviation at the central region of the strip between the measured and desired tensile stress distribution, determining a deviation at the edge region of the strip between the measured and desired tensile stress distribution, forming a strip center coefficient from the central region deviation in the form of a deviation control for influencing deflection of the intermediate roll, and forming a strip edge coefficient from the edge region deviation in the form of a deviation control for influencing deflection of the working roll. It should be noted that two strip edge coefficients can also be formed which always correlate a respective one of the two strip regions with the tensile stress distribution, and act on the respective corresponding side of the working rolls.

In accordance with another mode of the invention, there is provided a method which comprises approximating the tensile stress deviations at the central and edge regions of the strip with coefficients of respective compensation parabolas, and forming the strip center and strip edge coefficients from the coefficients of the parabolas. Accordingly, this practical embodiment of the invention provides that in a measurement-value processing device, the tensile stress processing devices are approximated in the strip-center region and in the strip-edge region by a compensation parabola and the strip-center coefficient and the strip edge coefficient (or the strip edge coefficients) are formed from the parabola coefficient. It may be advantageous in this case, because of the intermediate roll deflection present over the entire width of the strip, to approximate the tensile-stress errors (deviation of the measured tension from a specified tension stress curve) in the central region of the strip by using a square parabola (for instance, according to the method of least mean squares) and to utilize the coefficient of the square term as the strip-center coefficient. Since the deflection of the working rolls predominantly affects the strip edge regions, the associated bending line can frequently be described more accurately by a higher-order parabola or a linear combination of such parabolas, so that a suitable strip-edge coefficient can be formed from the higher parabola coefficients.

In accordance with a further mode of the invention, there is provided a method which comprises determining a location of the strip at which deflection of the working roll has the greatest effect, and placing a boundary between the center and edge regions of the strip at the location of greatest effect, i.e. where it sets in distinctly. As a rule, this point can be determined empirically. In principle, however, it is also possible to fix a suitable delineation of the strip-center region and the strip-edge region by stiffness calculations.

If the compensation parabola is only determined by means of the tensile stress errors in the boundary regions as a defect of the working-roll deflection, it may also contain error components which are influenced by the deflection of the intermediate rolls.

In accordance with an added mode of the invention, there is provided a method which comprises forming a correction quantity in dependence on the magnitude of the strip center coefficient and taking into consideration the influence of the deflection of the intermediate roll on the tensile stress distribution at the edge region of the strip, and impressing the correction quantity on the strip edge coefficient. This is done for further decoupling the mutual interaction of the working-roll deflection and the deflection of the intermediate rolls.

In accordance with an additional mode of the invention, there is provided a method which comprises feeding the strip center coefficient to a decoupling member effected by the influence of the deflection of the intermediate roll on the tensile stress distribution in the central region of the strip, and transforming the strip center coefficient into a correction quantity for the strip edge coefficient with the decoupling member.

In accordance with again another mode of the invention, there is provided a method which comprises forming a correction quantity in dependence on the magnitude of the strip edge coefficient and taking into consideration the influence of the deflection of the working roll on the tensile stress distribution at the center region of the strip, and impressing the correction quantity on the strip center coefficient.

In accordance with again a further mode of the invention, there is provided a method which comprises feeding the strip edge coefficient to a decoupling member effected by the influence of the deflection of the working roll on the tensile stress distribution in the edge region of the strip, and transforming the strip edge coefficient into a correction quantity for the strip center coefficient with the decoupling member.

The mutual interlinking of the strip-center and strip-edge coefficients with decoupling stages, achieves an optimum effect of the control of the working and the intermediate-roll deflection by compensating mutually occurring error components.

The object of the invention is furthermore met by providing a circuit for controlling flatness in cold-rolling mills having a roll stand with at least six rolls including intermediate and working rolls capable of being deflected, comprising means for measuring tensile stress distribution over the width of a strip to be rolled having central and edge regions, means connected to the measuring means for comparing the measured tensile stress distribution with a desired predetermined tensile stress distribution forming a tensile stress distribution difference signal, a measured-value processing device having a measured-value input connected to the comparing means for forming a strip center coefficient and a strip edge coefficient from the tensile stress distribution difference signal, first and second control lines connected to the measured-value processing device, at least one first control element connected to the first control line for controlling deflection of the intermediate roll, and at least one second control element connected to the second control line for controlling deflection of the working roll.

In accordance with another feature of the invention, there is provided a decoupling device having first and second summing stages respectively connected in the first and second control lines, first means connected between the first control line and the second summing stage for adding a correction quantity from the first to the second control line, and second means connected between the second control line and the first summing stage for adding a correction quantity from the second to the first control line. In other words, the correction quantity depending on one output signal is fed to the other output signal of the measured-value processing device. This is done for compensating mutual error components.

In accordance with further feature of the invention, the first adding means is a decoupling stage forming the correction quantity to be added to the strip edge coefficient in dependence on the magnitude of the strip center coefficient and the influence of the deflection of the intermediate roll on the tensile stress distribution at the edge region of the strip, and the second adding means is a decoupling stage forming the correction quantity to be added to the strip center coefficent in dependence on the magnitude of the strip edge coefficient and the influence of the deflection of the working roll on the tensile stress distribution at the center region of the strip. This can be achieved, for instance, by multiplying the signal of the other control line by a constant or a dynamic quantity.

In accordance with an added feature of the invention, there is provided a dynamic transmission member connected in at least one of the control lines. This is done since as a rule, the control circuits for the intermediate-roll deflection and the working-roll deflection exhibit a different dynamic behavior. In order to obtain an optical control, it is therefore frequently insufficient to connect the output signals of the measured-value processing device through linear, time-wise uninfluenced transmission stages at the working or intermediate-roll deflection controls.

In accordance with an additional feature of the invention, there is provided a first dynamic transmission member disposed in the first control line between the decoupling device and the first control element or the measured-value processing device for controlling deflection of the intermediate roll, and a second dynamic transmission member disposed in the second control line between the decoupling device and the second control element or the measured-value processing device for controlling deflection of the working roll.

In accordance with again another feature of the invention, there are provided first and second branching points respectively connected to the first and second control lines and first and second dynamic transmission members respectively connected to the first and second control lines between the summing stages and the branching points, the first adding means being a first decoupling device connected to the first control line at the first branching point, and the second adding means being a second decoupling device connected to the second control line at the second branching point.

In accordance with again an added feature of the invention, the dynamic transmission members are PI controllers.

In accordance with a concomitant feature of the invention, there is provided an electronic data processor or processing computer connected to the comparing means for converting the measured values of the tensile stress distribution into control signals for deflection of the working and intermediate rolls.

Other features which are considered as characteristic for the invention are set forth in the appended claims.

Although the invention is illustrated and described herein as embodied in a method and circuit for flatness control in rolling mills, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
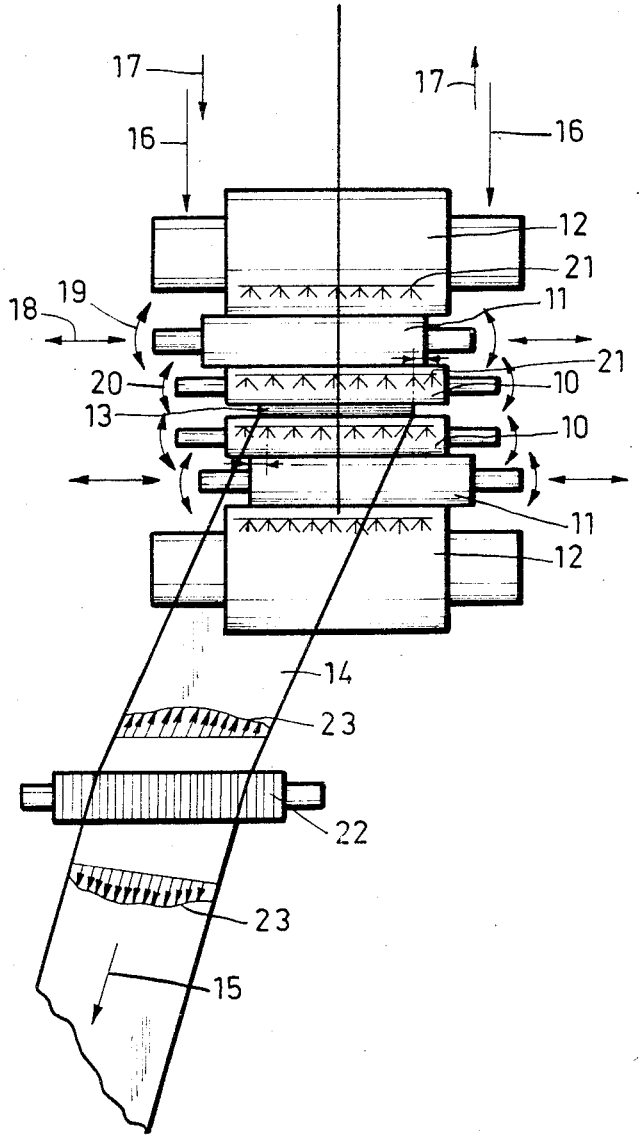
FIG. 1 is a fragmentary, diagrammatic, front-elevational view of a 6-roll stand followed by a tensile stress measuring device.

Referring now to the figures of the drawings in detail and first, particularly to FIG. 1 thereof, there is seen a 6-roll stand including two working rolls 10, two intermediate rolls 11 and two support rolls 12. Material 13 to be rolled can be seen between the working rolls 10. The material leaves the roll stand as a strip 14 in the direction of an arrow 15. The support rolls 12 are acted upon by rolling forces 16 and differential rolling forces 17 for compensating wedge-shaped strip defects. The intermediate rolls 11 can be axially shifted by axial forces 18 and can be bent by bending forces 19 in such a manner that the axis of the intermediate rolls is curved. The working rolls 10 can be similarly acted upon by bending forces 20. Parabolic errors in the tensile stress distribution can be counteracted by deflecting the working rolls 10 and the intermediate rolls 11. In addition, the roll stand contains several sets of cooling nozzles 21, by means of which parabolic and irregular defects in the tensile stress distribution can be equalized by influencing the coolant quantity and distribution.

The roll stand is followed by a tensile stress distribution measuring device 22 which is formed of a multiplicity of measuring discs. The tensile stress distribution 23 is shown in the form of arrows on both sides of the tensile stress distribution device 22.

Figure 2:
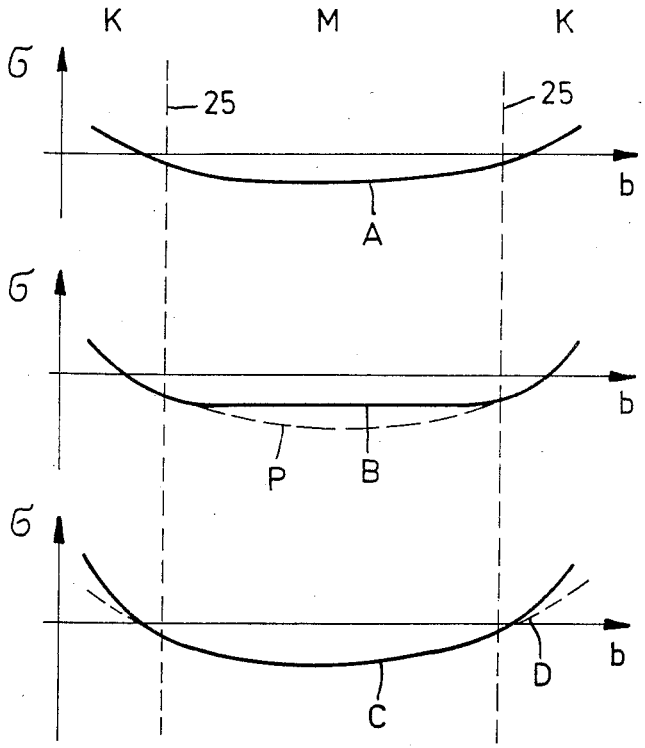
FIG. 2 is a graph showing tensile stress distribution curves.

Such tensile stress distribution can also be seen in FIG. 2. FIG. 2 shows the tensile stress deviation signma ($\sigma$) plotted in 3 diagrams over the width b of the strip.

Curve A shows the effect of an intermediate-roll deflection on the distribution of the tensile stress. This effect can be simulated essentially by a parabola.

Curve B shows the effect of a working-roll deflection on the tensile stress distribution. This type of deflection exhibits an approximately constant value in the center region M of the strip, the boundary of which is indicated by two broken lines 25. However, in edge regions K of the strip, great changes in the tensile stress deviation can be seen. If the center region of the strip is ignored, the shape of the curve in the edge regions K of the strip can be approximated by a parabola P (possibly a higher-order parabola) which as a rule deviates from the parabola characterized by the curve A.

Curve C represents a sum curve of curves A and B and shows the effects of the intermediate and working roll deflection on the tensile stress distribution. Such a curve shape can be the concrete result of a tensile stress distribution measurement, for instance.

It can be seen from curve C that in the center region M of the strip, the tensile stress distribution is essentially only influenced by a deflection of the intermediate rolls. In the edge regions K of the strip, a deflection of the intermediate rolls, as indicated by the broken line D, is not sufficient to reproduce the curve shape C. In this case, an additional deflection of the working rolls is necessary to reproduce the curve shape C.

Figure 3:
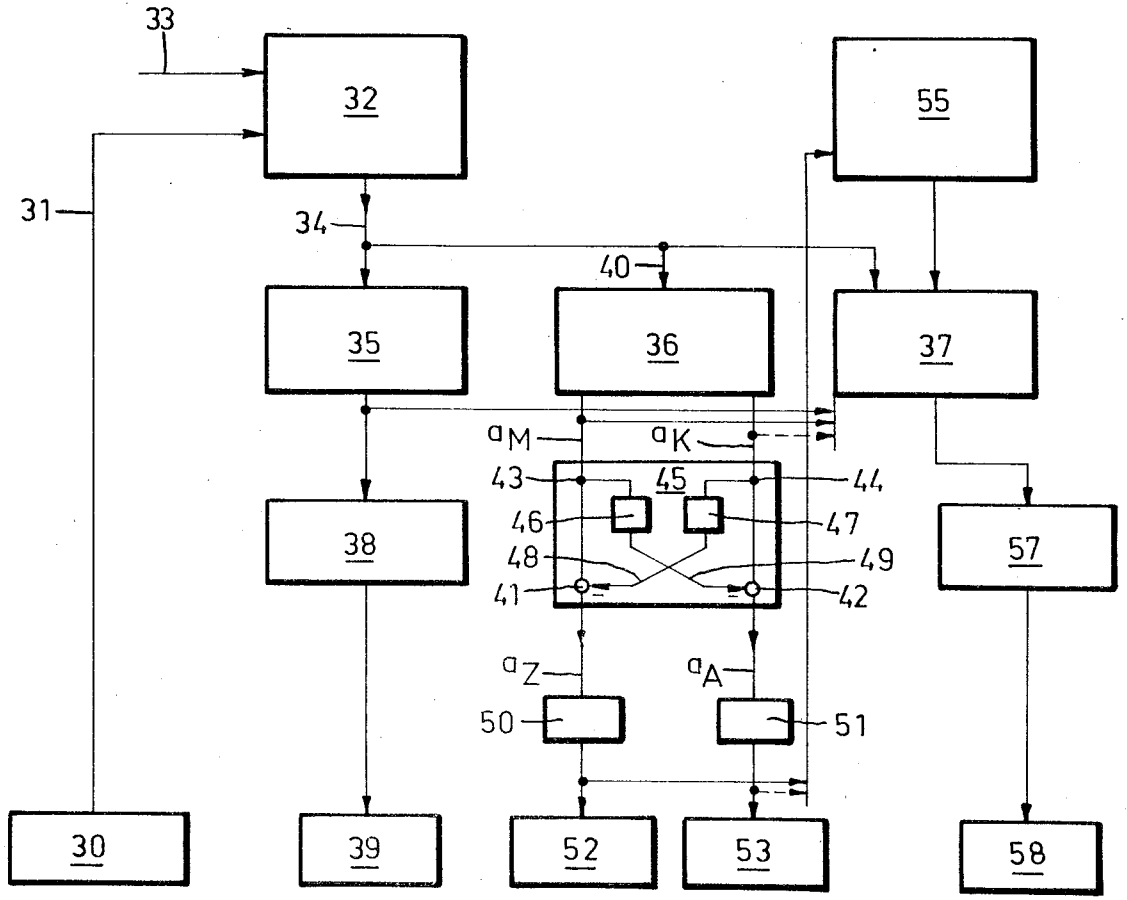
FIG. 3 is a master block circuit diagram of a flatness control with a schematic circuit diagram according to the invention.

FIG. 3 shows a master structure from which a method for controlling the flatness of material can be seen. The actual tensile stress distribution 31 is measured by a tensile stress distribution measuring device 30. The actual tensile stress distribution is compared in a measured-value analyzer 32 with a specified or desired tensile stress distribution 33. The measured-value analyzer 32 delivers distribution difference signals 34 which take the form of a signal line in the case of serial processing and which take the form of a multiplicity of signal lines in the case of parallel processing. The signals 34 are fed to an evaluation stage 35, a measured-value processing device 36 and a control unit 37 which satisfy or conform the deviation between the actual distribution 31 and the desired distribution 33.

The evaluation stage 35 analyzes the defect distribution according to the signal 34 with respect to its symmetrical shape. If the defect distribution has a wedge-shaped component, then the evaluation stage 35 gives a corrsponding signal to a position controller 38 which acts on the roll slant positioning device 39 (producing the rolling force difference or differential 17 according to FIG. 1).

The measured-value processing device 36 as well as the subsequent control of the intermediate and working-roll deflection is the subject of the present invention. Alternatives to the structure shown in FIG. 3 are found in FIGS. 4 to 6. Mutually corresponding circuit sections have been provided with the same reference numerals in the figures.

The defect distribution of the tensile stress according to the signal 34 is fed to the measured-value processing device 36 over a measured-value input 40. The signal 34 performs an evaluation of the defect distribution in such a way that it lays or plots an equalizing parabola through the measured values in the central strip region M by means of the method of least mean squares and likewise determines an equalizing parabola through the measured values of the two edge regions K of the strip. The limits or limit regions between the central strip region and the edge regions of the strip are determined empirically for this purpose and are fed to the measured-value processing device 36. The measured-value processing device 36 calculates a strip-center coefficient $a_M$ and a strip-edge coefficient $a_K$ from the equalizing parabolas and delivers corresponding output signals to summing stages 41, 42. In each of the two signal lines between the measured-value processing device 36 and the summing stages 41, 42, there is a branching point 43, 44, at which signals of the strip-center coefficients $a_M$ and strip-edge coefficients $a_K$ for a decoupling device 45 are branched off. Within the decoupling device 45, each signal arrives at a decoupling member or stage 46. The output signals of the decoupling stages 46, 47 are fed crosswise as correction quantities 49, 48 to the two summing stages 42, 41, respectively. The outputs of the summing stages 41, 42 are each connected to a controller 50, 51, which transforms the signals into control commands for control elements 52 for the intermediate-roll deflection and for control elements 53 for the working-roll deflection.

The decoupling device 45 serves the purpose of avoiding double consideration of bending defects and of achieving an optimum effect of the control of the roll deflection. To this end, the defects which act on the working-roll deflection are corrected by the defect components which are taken over by the intermediate-roll deflection and vice versa.

It can be seen from FIG. 2, for instance, that an evaluation of the curve C in the edge region K of the strip, includes the components of the working-roll deflection as well as the components of the intermediate-roll deflection. The parabola coefficient $a_K$ which has been determined is therefore larger than is required for controlling the working-roll deflection. In order to obtain a corrected parabola coefficient $a_K$ for the working-roll deflection, the parabola coefficient $a_K$ can be subjected to the correction quantity 49 which depends on the parabola coefficient $a_M$ (of the curve D). The relationship $$a_A = a_K - K_1 \cdot a_M$$

is therefore obtained (or, for a correction of the intermediate-roll deflection, $a_Z = a_M - K_2 \cdot a_K$). The factors $K_1$ and $K_2$ are transfer factors of the decoupling stages 46 and 47. They may be constant or dynamic factors.

As mentioned above, the defect distribution is fed as the signal 34 to a control element 37 which is part of a cooling nozzle control device. The cooling nozzle control device is formed of an operating point monitor 55 (which evaluates the control signals of the control elements for the intermediate and working-roll deflection), the above-mentioned control element 37 (which processes the output signals of the evaluation stage 35 as well as the output signals of the measured-value processing device 36), and a cooling zone control 57, in which the signals of the control element 37 are processed. Cooling nozzles which are given reference numeral 58 in FIG. 3 are addressed by the cooling zone control 57.

Figure 4:
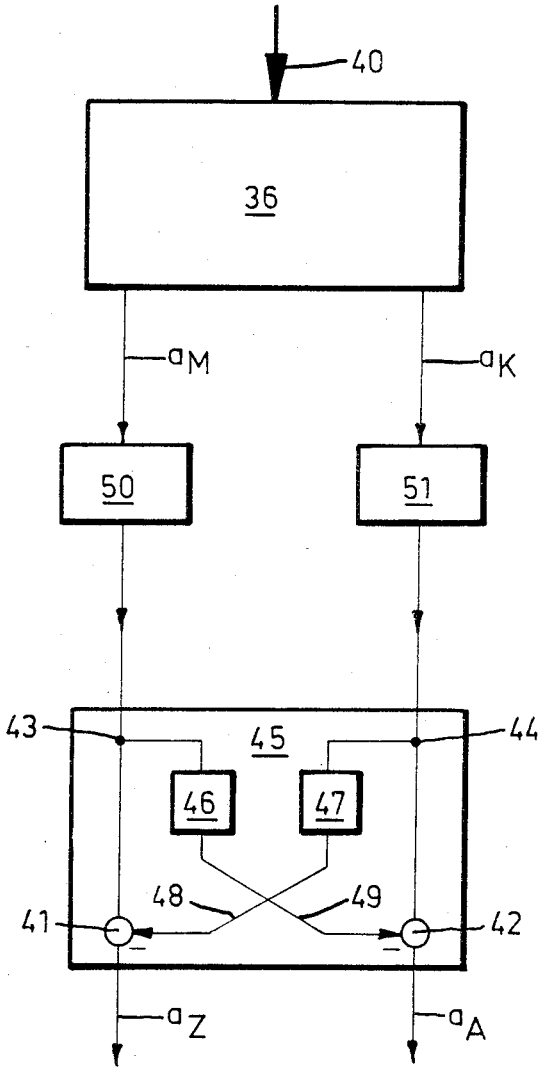
FIGS. 4 to 6 are block circuit diagrams showing various circuits according to the invention.
Figure 5:
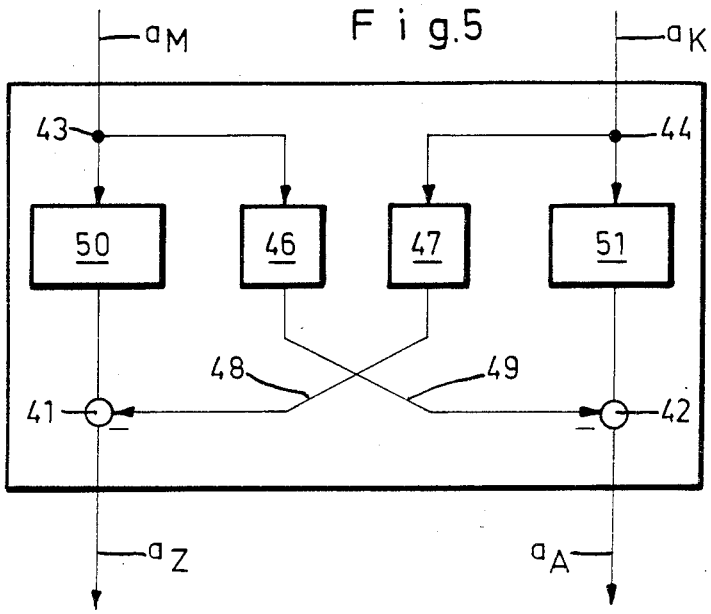
Figure 6:
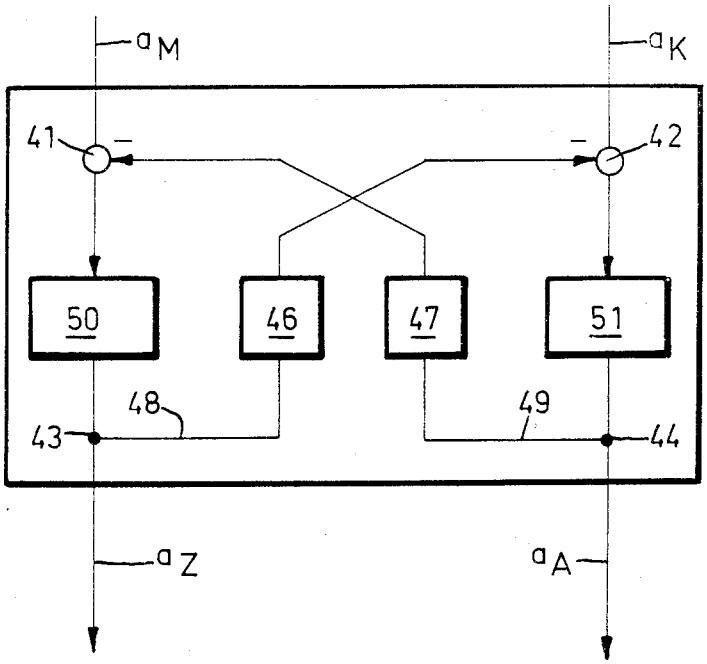

FIGS. 4, 5 and 6 show variations of the intermediate-roll and working-roll deflection controls and only differ from the device shown in FIG. 3 by the location of the controllers 50, 51. In FIG. 4, the controllers 50, 51 are connected directly to the outputs of the measured-value processing device 36. In FIGS. 5 and 6, the controllers 50, 51 are each located between a respective branching point 43, 44 and the corresponding summing stage 41, 42. In FIG. 6, the locations of the branching points 43, 44 and the summing stages 41, 42 are interchanged as compared to FIG. 5.

The controls 50, 51 may be dynamic transmission stages such as PI controllers, for instance.

I claim:

1. Method for controlling flatness in cold-rolling mills having a roll stand with a least six rolls including intermediate and working rolls capable of being deflected, which comprises measuring tensile stress distribution over the width of a strip to be rolled having central and edge regions, comparing the measured tensile stress distribution with a desired predeterminable tensile stress distribution, determining a deviation at the central region of the strip between the measured and desired tensile stress distribution, determining a deviation at the edge region of the strip between the measured and desired tensile stress distribution, forming a strip center coefficient from the central region deviation in the form of a deviation control for influencing deflection of the intermediate roll, and forming a strip edge coefficient from the edge region deviation in the form of a deviation control for influencing deflection of the working roll.

2. Method according to claim 1, which comprises approximating the tensile stress deviations at the central and edge regions of the strip with coefficients of respective compensation parabolas, and forming the strip center and strip edge coefficients from the coefficients of the parabolas.

3. Method according to claim 1, which comprises determining a location of the strip at which deflection of the working roll has the greatest effect, and placing a boundary between the center and edge regions of the strip at the location of the greatest effect.

4. Method according to claim 1, which comprises forming a correction quantity in dependence on the magnitude of the strip center coefficient and the influence of the deflection of the intermediate roll on the tensile stress distribution at the edge region of the strip, and impressing the correction quantity on the strip edge coefficient.

5. Method according to claim 4, which comprises feeding the strip center coefficient a decoupling member effected by the influence of the deflection of the intermediate roll on the tensile stress distribution in the central region of the strip, and transforming the strip center coefficient into a correction quantity for the strip edge coefficient with the decoupling member.

6. Method according to claim 1, which comprises forming a correction quantity in dependence on the magnitude of the strip edge coefficient and the influence of the deflection of the working roll of the tensile stress distribution at the center region of the strip, and impressing the correction quantity on the strip center coefficient.

7. Method according to claim 4, which comprises feeding the strip edge coefficient to a decoupling member effected by the influence of the deflection of the working roll on the tensile stress distribution in the edge region of the strip, and transforming the strip edge coefficient into a correction quantity for the strip center coefficient with the decoupling member.

8. Circuit for controlling flatness in cold-rolling mills having a roll stand with at least six rolls including intermediate and working rolls capable of being deflected, comprising means for measuring tensile stress distribution over the width of a strip to be rolled having central and edge regions, means connected to said measuring means for comparing the measured tensile stress distribution with a desired predetermined tensile stress distribution forming a tensile stress distribution difference signal, a measured-value processing device having a measured-value input connected to said comparing means for forming a strip center coefficient and a strip edge coefficient from said tensile stress distribution difference signal, first and second control lines connected to said measured-value processing device, at least one first control element connected to said first control line for controlling deflection of the intermediate roll, and at least one second control element connected to said second control line for controlling deflection of the working roll.

9. Circuit according to claim 8, including a decoupling device having first and second summing stages respectively connected in said first and second control lines, first means connected between said first control line and said second summing stage for adding a correction quantity from said first to said second control line, and second means connected between said second control line and said first summing stage for adding a correction quantity from said second to said first control line.

10. Circuit according to claim 9, wherein said first adding means is a decoupling stage forming the correction quantity to be added to the strip edge coefficient in dependence on the magnitude of the strip center coefficient and the influence of the deflection of the intermediate roll on the tensile stress distribution at the edge region of the strip, and said second adding means is a decoupling stage forming the correction quantity to be added to the strip center coefficient in dependence on the magnitude of the strip edge coefficient and the influence of the deflection of the working roll on the tensile stress distribution at the center region of the strip.

11. Circuit according to claim 8, including a dynamic transmission member connected in at least one of said control lines.

12. Circuit according to claim 9, including a first dynamic transmission member disposed in said first control line between said decoupling device and said first control element for controlling deflection of the intermediate roll, and a second dynamic transmission member disposed in said second control line between said decoupling device and said second control element for controlling deflection of the working roll.

13. Circuit according to claim 9, including a first dynamic transmission member disposed in said first control line between said decoupling device and said measured-value processing device for controlling deflection of the intermediate roll, and a second dynamic transmission member disposed in said second control line between said decoupling device and said measured-value processing device for controlling deflection of the working roll.

14. Circuit according to claim 9, including first and second branching points respectively connected to said first and second control lines, and first and second dynamic transmission members respectively connected to said first and second control lines between said summing stages and said branching points, said first adding means being a first decoupling device connected to said first control line at said first branching point, and said second adding means being a second decoupling device connected to said second control line at said second branching point.

15. Circuit according to claim 11, wherein said dynamic transmission members are PI controllers.

16. Circuit according to claim 12, wherein said dynamic transmission members are PI controllers.

17. Circuit according to claim 13, wherein said dynamic transmission members are PI controllers.

18. Circuit according to claim 14, wherein said dynamic transmission members are PI controllers.

19. Circuit according to claim 8, including an electronic data processor connected to said comparing means for converting the measured values of the tensile stress distribution into control signals for deflection of the working and intermediate rolls.

* * * * *